US008054200B1

(12) United States Patent
Nelson

(10) Patent No.: US 8,054,200 B1
(45) Date of Patent: Nov. 8, 2011

(54) CONTROL APPARATUS, METHOD, AND ALGORITHM FOR TURNING ON WARNING IN RESPONSE TO STROBE

(75) Inventor: Gregory K Nelson, Minneapolis, MN (US)

(73) Assignee: Neva Products, LLC, Apple Valley, MN (US)

( * ) Notice: Subject to any disclaimer, the term of this patent is extended or adjusted under 35 U.S.C. 154(b) by 426 days.

(21) Appl. No.: 12/316,441

(22) Filed: Dec. 11, 2008

(51) Int. Cl.
*G08B 21/00* (2006.01)

(52) U.S. Cl. ..... 340/901; 340/905; 340/425.5; 340/436; 701/301

(58) Field of Classification Search ..... 340/425.5, 340/436, 463–467, 901, 905; 701/301
See application file for complete search history.

(56) References Cited

U.S. PATENT DOCUMENTS 4,648,572 A 3/1987 Sokol
4,704,610 A 11/1987 Smith et al.
4,836,482 A 6/1989 Sokol
5,111,183 A 5/1992 Wang
5,111,207 A 5/1992 Allen
5,172,113 A * 12/1992 Hamer ..... 340/907
5,187,476 A 2/1993 Hamer
5,202,683 A 4/1993 Hamer et al.
5,276,703 A 1/1994 Budin et al.
5,495,243 A 2/1996 McKenna
5,539,398 A 7/1996 Hall et al.
5,550,718 A 8/1996 Shy
5,559,508 A * 9/1996 Orr et al. ..... 340/902
5,572,201 A 11/1996 Graham et al.
5,602,739 A 2/1997 Haagenstad et al.
5,621,571 A 4/1997 Bantli et al.
5,631,627 A 5/1997 Chou
5,657,008 A 8/1997 Bantli
6,087,961 A 7/2000 Markow
6,094,148 A * 7/2000 Henry et al. ..... 340/902
6,252,519 B1 6/2001 McKenna
6,300,882 B1 10/2001 Inoue
6,449,540 B1 9/2002 Rayner
6,520,667 B1 2/2003 Mousseau
6,529,831 B1 * 3/2003 Smith et al. ..... 701/301
6,686,849 B1 2/2004 Cullett
6,687,587 B2 2/2004 Kacel
6,728,612 B1 4/2004 Carver et al.
6,779,765 B2 8/2004 Zheng et al.
6,799,873 B2 10/2004 Fox
6,804,525 B2 10/2004 Davis et al.
6,819,939 B2 11/2004 Masamura
6,823,198 B2 11/2004 Kobayashi
6,845,316 B2 1/2005 Yates
6,853,910 B1 2/2005 Oesterling et al.
6,950,745 B2 9/2005 Agnew et al.
7,054,725 B2 5/2006 Burch et al.
7,061,402 B1 6/2006 Lawson
7,162,364 B2 1/2007 Bahren et al.
7,208,881 B2 4/2007 Young (Continued)

*Primary Examiner* — Jennifer Mehmood
*Assistant Examiner* — Mark Rushing

(57) ABSTRACT

A right of way vehicle throws out a strobe light having pulses. The strobe light is picked up by the present control apparatus, which analyzes the pulses of the strobe light via an algorithm, and then sets off an alarm or warning device if the strobe light meets the conditions of the algorithm. The control apparatus includes a sensor component, a signal conditioner component, a microcontroller component, and an alarm or warning device component. The components may be housed as a package and located in the interior of a vehicle. The components may be housed separately or in separate packages. The separately housed components or separately housed packages may be located at various locations on or in the vehicle.

16 Claims, 3 Drawing Sheets

U.S. PATENT DOCUMENTS

| | | | |
|---|---|---|---|
| 7,212,155 | B2 | 5/2007 | Hatch et al. |
| 7,271,736 | B2 | 9/2007 | Siegel et al. |
| 7,313,477 | B1 | 12/2007 | Laverick et al. |
| 7,446,674 | B2 | 11/2008 | McKenna |
| 7,538,687 | B2 | 5/2009 | McKenna |
| 2002/0008635 | A1 | 1/2002 | Ewing et al. |
| 2003/0040868 | A1 | 2/2003 | Fish et al. |
| 2003/0141990 | A1 | 7/2003 | Coon |
| 2003/0201906 | A1 | 10/2003 | Buscemi |
| 2004/0148091 | A1 | 7/2004 | Masclet et al. |
| 2004/0148102 | A1 | 7/2004 | McCarthy et al. |
| 2005/0024189 | A1 | 2/2005 | Weber |
| 2005/0090970 | A1 | 4/2005 | Barkowski |
| 2005/0231385 | A1 | 10/2005 | Haase |
| 2006/0255966 | A1 | 11/2006 | McKenna |
| 2007/0046499 | A1 | 3/2007 | McKenna |
| 2007/0139221 | A1 | 6/2007 | Falvey |
| 2007/0262649 | A1 | 11/2007 | Ozawa et al. |
| 2008/0253079 | A1 | 10/2008 | Robinson et al. |
| 2009/0174571 | A1 * | 7/2009 | McKenna ..... 340/901 |

* cited by examiner

```
                    Algorithm for Signal Detection
Start

Initialize all variables
        "count" is the current number of consecutive correctly spaced
                pulses
        "last timer value" the timer count from the last pulse
        "current timer value" the timer count from the current active
                pulse
        "interval" required time between pulse +/- a tolerance
        "pulses" the required number of consecutive correctly spaced
                pulses before alarm
Initialize digital input and output
Initialize timers

while (true)
        read digital input from sensor/conditioner
        if signal is active (meaning an ir pulse is present)
                move current timer value to last timer value
                read timer value and store in current timer value
                subtract last timer value from current timer value
                        if result is equal to interval (+/- a tolerance)
                increment count
                if count is equal to pulses
                        activate alarm, turn off alarm after delay
                        clear count
                else loop back to read digital input
                else clear count and loop back to read digital input
        else loop back and read digital input
```

Fig. 3

CONTROL APPARATUS, METHOD, AND ALGORITHM FOR TURNING ON WARNING IN RESPONSE TO STROBE

FIELD OF THE INVENTION

The present invention generally relates to a control apparatus, method and algorithm for turning on an audio and/or visual warning in response to a strobe light.

BACKGROUND OF THE INVENTION

A great many intersections in the United States of America and Canada utilize the Opticom Priority Control System, a type of control system that provides intersection right-of-way to authorized vehicles. The system may be related to the technology found in the following U.S. Patents, which are incorporated by reference in their entireties into this application: 1) the Hamer U.S. Pat. No. 5,172,113 issued Dec. 15, 1992 and entitled System And Method For Transmitting Data In An Optical Traffic Preemption System; 2) the Hamer U.S. Pat. No. 5,187,476 issued Feb. 16, 1993 and entitled Optical Traffic Preemption Detector Circuitry; 3) the Hamer U.S. Pat. No. 5,187,476 issued Feb. 16, 1993 and entitled Optical Traffic Preemption Detector Circuitry; 4) the Hamer et al. U.S. Pat. No. 5,202,683 issued Apr. 13, 1993 and entitled Optical Traffic Preemption Detector; and 5) the Haagenstad et al. U.S. Pat. No. 5,602,739 issued Feb. 11, 1997 and entitled Vehicle Tracking System Incorporating Traffic Signal Preemption. This technology, or particularly the type of signals that are emitted by right-of-way vehicles, where these signals include a set of 14 pulses of light per second, can be put to great advantageous use a) because this technology is already part of a traffic system widely employed, b) because this technology, or set of 14 pulses of light per second, is being emitted freely without cost to a driver of a vehicle, c) because no additional structure or features are added to the traffic infrastructure, such as to traffic lights at intersection, and thus there is no added expense to the traffic infrastructure, and d) because there are no additional expenditures that would be required by the departments of transportation of the many states.

The Henry et al. U.S. Pat. No. 6,094,148 issued Jul. 25, 2000 and entitled Vehicular Emergency Vehicle Alarm Apparatus provides a demodulator connected between the sensor and the alarm for demodulating signals produced by the sensor and for generating an alarm signal only when the incident light is modulated at a frequency to which the demodulator is responsive. The demodulator includes a pulse counter coupled to the sensor for counting pulses produced by the sensor in a fixed length time period and an AND gate receiving the outputs of the pulse counter and the sensor for comparing pulses counted in the fixed length time period to at least one frequency to which the demodulator is responsive and for rejecting frequencies not corresponding to the modulated frequency to which the demodulator is responsive. The Henry et al. U.S. Pat. No. 6,094,148 details the detection of signals with the correct pulse repetition rate (frequency) and an unspecified sequential number of correctly spaced pulses (with what the Henry et al. patent terms a demodulator), using a discrete hardware pulse counter and AND gate. Hardware is electronic circuitry fixed at the time of design and built using physical components. This design once built may not be changed and is fixed at the time of construction. For example, a radio is designed and built as one, and forever will be one; and cannot be turned into a television. Function is fixed by the use of discrete hardware.

SUMMARY OF THE INVENTION

A feature of the invention is the provision between a strobe light sensor and an audio or visual warning device, of a control apparatus including a microcontroller for turning on the warning device in response to a strobe light.

Another feature of the invention is the provision between a strobe light sensor and an audio or visual warning device, of a control apparatus including an algorithm for turning on the warning device in response to a strobe light.

Another feature of the invention is the provision between a strobe light sensor and an audio or visual warning device, of a control apparatus that performs the steps of a) sensing a pulse of light from said strobe and converting said pulse of light into an analog pulse; b) converting said analog pulse into a digital pulse; c) recording a first time for a first digital pulse; d) recording a second time for a second digital pulse that occurs consecutively after said first digital pulse; e) analyzing whether a time period between the first and second times have fallen into a required time interval, wherein said required time interval is a required time between the first and second digital pulses plus or minus a tolerance; f) counting a number of consecutive digital pulses that have fallen into said required time interval; and g) turning on said warning device when said number of consecutive digital pulses have attained a warning device requirement defined by a required number of consecutive digital pulses over a required period of time.

Another feature of the invention is the provision between a strobe light sensor and an audio or visual warning device, of a control apparatus including an algorithm for turning on the warning device in response to a strobe light, where the algorithm includes the step of detecting a frequency of strobe light pulses by measuring time between pulses.

Another feature of the invention is the provision between a strobe light sensor and an audio or visual warning device, of a control apparatus including an algorithm for turning on the warning device in response to a strobe light, where the algorithm includes the step of determining whether a specified sequential quantity of strobe light pulses has been received.

Another feature of the invention is the provision between a strobe light sensor and an audio or visual warning device, of a control apparatus including an algorithm for turning on the warning device in response to a strobe light, where the algorithm includes the combination of a) the step of detecting a frequency of strobe light pulses by measuring time between pulses and b) the step of determining whether a specified sequential quantity of strobe light pulses has been received.

The present control apparatus includes a sensor or detector sensitive to light, such as an infrared light. The source of the infrared light may be a strobe light mounted on a right of way vehicle. In response to the infrared light radiated by the strobe light, the sensor produces an analog signal or analog pulse.

The sensor is connected to a signal conditioner that converts the analog signal or analog pulse to a digital signal or digital pulse or digital pulse value useable by a microcontroller.

The microcontroller runs software that employs an algorithm. The algorithm monitors output from the signal conditioner and, when proper conditions are met, activates an audio or visual warning device.

The proper conditions are defined at least in part, if not entirely, by the strobe light of the right of way vehicle. The strobe light may have a modulation frequency from 14 to 30 hertz (or cycles per second or pulses per second). For instance, 14 hertz equals 14 cycles per second or 14 pulses per second. When a strobe light at the correct frequency is detected by the present control apparatus, the control apparatus activates the audio and/or visual warning device so as to warn the user that a right of way vehicle is approaching.

The control apparatus measures the time between digital pulses. An incoming modulated signal of 14 hertz has a pulse train with a time of 71.4 milliseconds between pulses.

The present control apparatus loops waiting for a first digital pulse from the sensor or detector via the signal conditioner. When a first digital pulse is received, the present control apparatus reads an onboard timer and records the time that this particular first digital pulse was detected. It then loops back and waits for a consecutive second digital pulse. When the consecutive second digital pulse is received, the control apparatus also time stamps this pulse, and at this time the control apparatus begins to measure and compare the time between pulses. This time between pulses can be referred to as a required interval. If a pulse is received that falls out of this required interval plus or minus some tolerance, then the present control apparatus rejects such a pulse and also rejects the total number of pulses that the control apparatus has recorded. When a required (or correct) number of pulses is received (each of the pulses having been consecutive and each of the pulses falling into the required interval, minus the first pulse), the present control apparatus commands activation of the warning device.

Finally, the control apparatus deactivates the audio and/or visual warning device after a specified amount of time, and the control apparatus rearms itself for further light signal detection and operation.

An advantage of the present invention is that the present control apparatus or present method is configurable. For example, "red light changers" are presently being marketed and purchased by "low standing" citizens. These "red light changers" throw out a strobe light at a correct frequency to change the lights of an intersection such that the "low standing" citizens save time at the expense of "upstanding" citizens. Thus, municipalities or other governmental organizations, right of way vehicle providers, and emergency service providers such as ambulance service providers, may have to change the pulse frequency of strobe lights placed on right of way vehicles. However, if the pulse frequency of the police car strobe light changes, then "upstanding" citizens who have right of way warning devices that provide warnings automatically when a police car strobe light is sensed, may have right of way warning devices that are not operational. These "upstanding" citizens then would be less likely to get out of the way of the police car. However, since the present invention is configurable, the "upstanding" citizens can still have, after the right of way warning device is reconfigured, an operational right of way warning device so as to aid in clearing the streets for police and patients in ambulances.

The present invention performs the detection of strobe light signals using a microcontroller and software. The software implements an algorithm and is the program that a computer runs to perform an intended function. One advantage of software over hardware is ease of change of function. For example, if at some time a function is found to be flawed, or a feature is to be added, a change in software can be made to correct or enhance it and the microcontroller reprogrammed, without replacing the original hardware upon which the program runs.

Another advantage of the present invention is that design and manufacturing processes are more efficient where software features are maximized and hardware features are minimized.

Another advantage of the present invention is that it makes no use of a discrete hardware demodulator having individual electronic components.

Another advantage of the present invention is that it makes no use of a discrete hardware pulse counter.

Another advantage of the present invention is that it makes no use of the hardware AND gate.

Another advantage of the present invention is that it makes no use other hardware gates such as NAND, OR, NOR, INV gates, and other hardware gates.

Another advantage of the present invention is that it makes use of a generic microcontroller running the present algorithm via software to effect the detection of strobe light pulses and control alarm activation.

Another advantage of the present invention is that hardware has been minimized in the control of system behavior.

Another advantage of the present invention is that software has been maximized in the control of system behavior.

Other advantages of the present algorithm based invention is that it: a) is easy to design and manufacture, b) is reprogrammable at the factory or in the field, c) is easy to change in response to a third party's specification, d) is easy to add new specifications, e) provides more intelligence or more functionality per dollar, f) can implement advanced algorithms, and g) is configurable by the end user.

BRIEF DESCRIPTION OF THE DRAWINGS

FIG. 3 illustrates the present algorithm of FIGS. 1 and 2.

DETAILED DESCRIPTION

Figure 1:
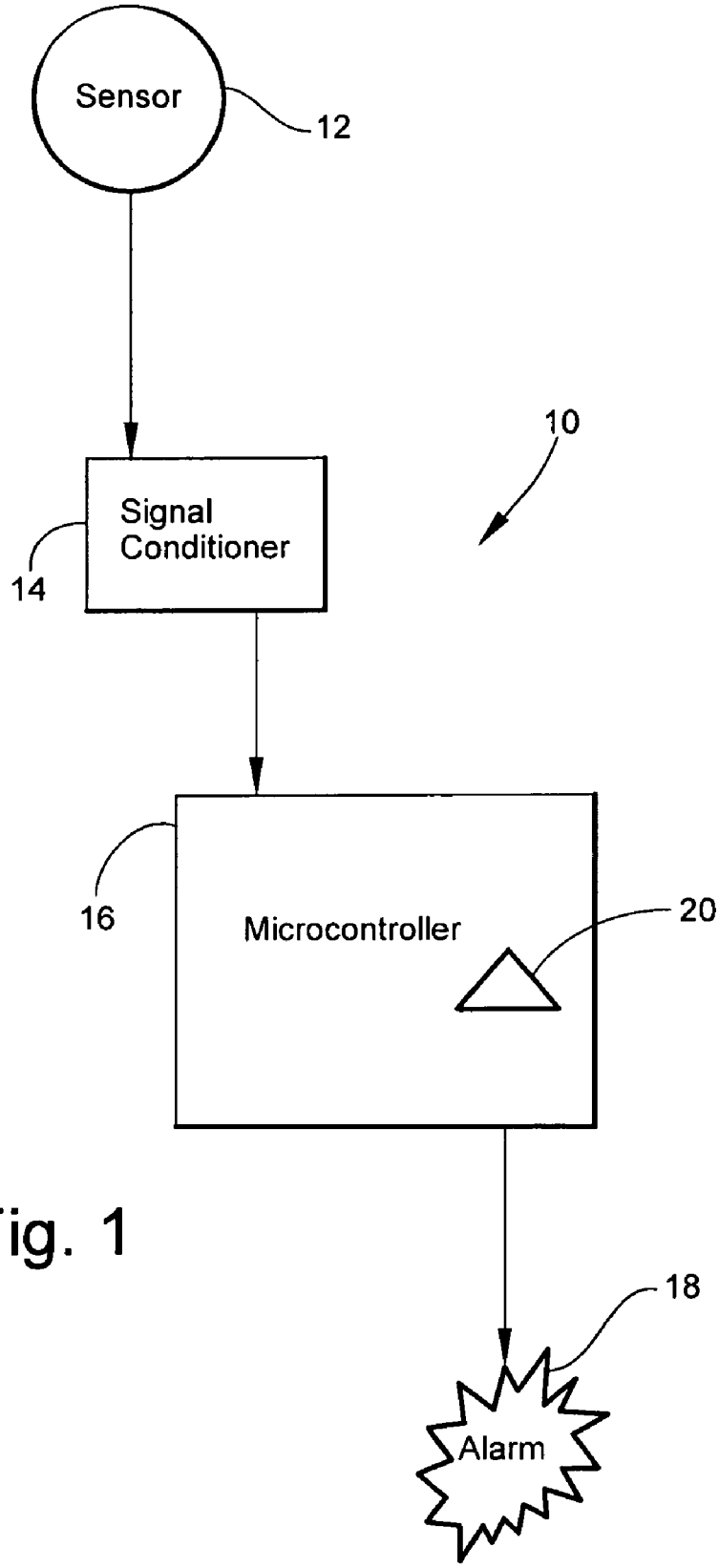
FIG. 1 is a block diagram that shows a microcontroller in relation to a sensor, signal conditioner and alarm or warning device, where the microcontroller employs the present algorithm.

As shown in FIG. 1, the present control apparatus is indicated in general by reference number 10. Control apparatus 10 includes a sensor 12, a signal conditioner 14, a microcontroller 16, and an alarm or warning device 18. The microcontroller 16 employs an algorithm 20. Algorithm 20 may be defined as 1) a sequence of finite instructions, 2) a procedure or formula for solving a problem, 3) a small procedure that solves a recurrent problem, or 4) a set of rules for solving a problem in a finite number of steps.

The Strobe Light

The present control apparatus 10 turns on a warning in response to a strobe light. A strobe light or stroboscopic lamp or strobe is a device used to produce regular flashes of light. A strobe light or stroboscopic lamp or strobe is a pulsed illumination source which uses a lamp generating a short burst of high intensity light.

Sensor 12 may be selected to be responsive to a strobe light such as a gas discharge strobe light or incandescent strobe light or xenon discharge strobe light. Incandescent light or gas sources may have relatively high energy consumption, relatively short lifetimes, and relatively high maintenance costs. Sensor 12 may be selected to be responsive to LED (light emitting diode) strobe lights. As to an LED strobe light, the Young U.S. Pat. No. 7,208,881 B2 issued Apr. 24, 2007 and entitled LED Strobe Light is hereby incorporated by reference in its entirety.

A strobe light may have a number of features. For example, one feature of a strobe light is its spectrum of radiated energy. A spectrum may be defined as an array of entities, such as light waves or particles, ordered in accordance with the magnitudes of a common physical property, such as wavelength or mass. For instance, sunlight has a visible light spectrum and this visible light spectrum is shown when sunlight passes through a prism. The prism will cast an array of red, orange, yellow, green, blue, indigo and violet. The spectrum of the sun also includes ultraviolet light and infrared light.

A strobe light spectrum may include ultraviolet light, visible light, and infrared light. In other words, a strobe light may radiate energy in a particular range. For example, a particular strobe light may radiate energy from about 100 nanometers to about 1000 nanometers. In other words, the spectrum of radiated energy of such particular strobe light is about 100 nanometers to about 1000 nanometers. The range of such particular strobe light thus covers ultraviolet light (about 100 nanometers to about 400 nanometers), visible light (about 400 to about 700 nanometers), and infrared (IR) light (about 800 nanometers to about one millimeter). A nanometer is one billionth ($1/1{,}000{,}000{,}000$) of a meter. A millimeter is one thousandths ($1/1000$) of a meter.

Another feature of a strobe light is the amount of energy radiated by the particular portions of the spectrum of the strobe light. For example, a particular strobe light may radiate about 30 percent of its total light energy into the visible portion of the light spectrum and the remaining 70 percent of its total light energy distributed evenly between the ultraviolet and infrared portions of the light spectrum. The amount of energy radiated by the strobe light directly relates to the intensity of the strobe light.

Another feature of a strobe light is its flash duration or length of time that it radiates energy. For example, a particular strobe light may have a flash duration of about 0.2 seconds. A longer flash duration may not make the flash of the strobe light appear more intense. A shorter flash duration may not make the flash of the strobe light appear less intense.

Another feature of a strobe light is its rest duration or time between flashes.

Another feature of a strobe light is its frequency or number of times that it flashes over a given time interval. Some strobe lights may flash five times per second; a pulse of such a strobe light may have a relatively long flash duration and a relatively long rest duration. Other strobe lights may flash 14 times per second. Still other strobe lights may flash 70 times per second; a pulse of such a strobe light may have a relatively short flash duration and a relatively short rest duration.

The Sensor 12

A photocell is a type of light detector or sensor. When light strikes the cell, current is permitted to flow more freely. When the photocell is in a dark environment, its current output decreases dramatically. A photocell may be calibrated to be responsive to a particular lighting scenario. A photocell can also be referred to as a photoresistor or light dependent resistor or photoconductor or photodetector whose resistance decreases with increasing incident light intensity. A photocell may be a phototransistor. A photocell may be a photodiode. A photodiode is a type of photodetector that converts light into either of current or voltage. Sensor 12 may be selected from one or more of a photocell, photoresistor, photoconductor, photodetector, phototransistor and photodiode.

Sensor 12 may be selected in relation to the light spectrum. For example, the sensor 12 may selectively include lead sulfide and indium antimonide, materials that may be selectively used for a middle region of the infrared portion of the light spectrum. The sensor 12 may selectively include Germanium (Ge) and copper (Cu), materials that may be selectively used for the far region of the infrared portion of the light spectrum.

In other words, a certain material may have a certain bandgap. Photons from a light source must have sufficient energy to excite electrons across the bandgap of the certain material in order to produce the requisite analog current. For example, sensor 12 may selectively include silicon, a material that is selectively photo responsive to a wavelength range from about 190 nanometers to about 1100 nanometers. Sensor 12 may selectively include Germanium, a material that is selectively photo responsive to a wavelength range from about 400 nanometers to about 1700 nanometers. Sensor 12 may selectively include indium gallium arsenide, a material that is selectively photo responsive to a wavelength range from about 800 nanometers to about 2600 nanometers. Sensor 12 may selectively include lead sulfide, a material that is selectively photo responsive to a wavelength range from about 1000 (or less) nanometers to about 3500 nanometers.

In response to one pulse of a strobe light, sensor 12 generates, as a correlated output, one pulse of analog current or a singular analog signal or analog pulse. This analog signal or analog pulse is then digitized through a signal conditioner 14 to produce a correlated digital value or digital pulse.

The Signal Conditioner 14

Signal conditioner 14 is electrically connected between the sensor 12 and the microcontroller 16. Signal conditioner 14 converts the analog signal or analog pulse from sensor 12 into a digital value or digital pulse useable by the microcontroller 16. In other words, the analog signal form is converted from an analog domain to a digital domain.

The analog signal or analog pulse generated by the photocell 12 carries with it certain information. This certain information may include 1) the amount of light energy (or light intensity) of one pulse of strobe light 2) the duration of the flash or the duration of one pulse of strobe light, and 3) the time between pulses of strobe light. The signal conditioner 14 may ignore an analog pulse of insufficient intensity. As to analog pulses having sufficient intensity or a voltage above a certain level (a threshold level), the signal conditioner 14 converts the duration of the flash or time of one pulse. Light intensity is an attribute of a pulse of strobe light that the microcontroller 16 does not take into account.

The Microcontroller 16

Microcontroller 16 is a functional computer system disposed on a chip. Features of microcontroller 16 include 1) a processor core or integrated central processing unit (CPU), 2) a memory having read-only memory for program storage and/or read-write memory for data storage and/or flash memory for permanent data storage, and 3) programmable input/output peripherals. In contrast, a microprocessor features merely a central processing unit. Like a microprocessor, microcontroller 16 includes arithmetic and logic elements.

Further attributes of microcontroller 16 include 1) a consumption of power on the order of only milliwatts or microwatts or nanowatts, 2) a capability to retain functionality while waiting for an event such as a pulse signal, 3) a relatively small size (chip size); and 4) a relatively low design and manufacturing cost so as to be relatively economical.

Figure 2:
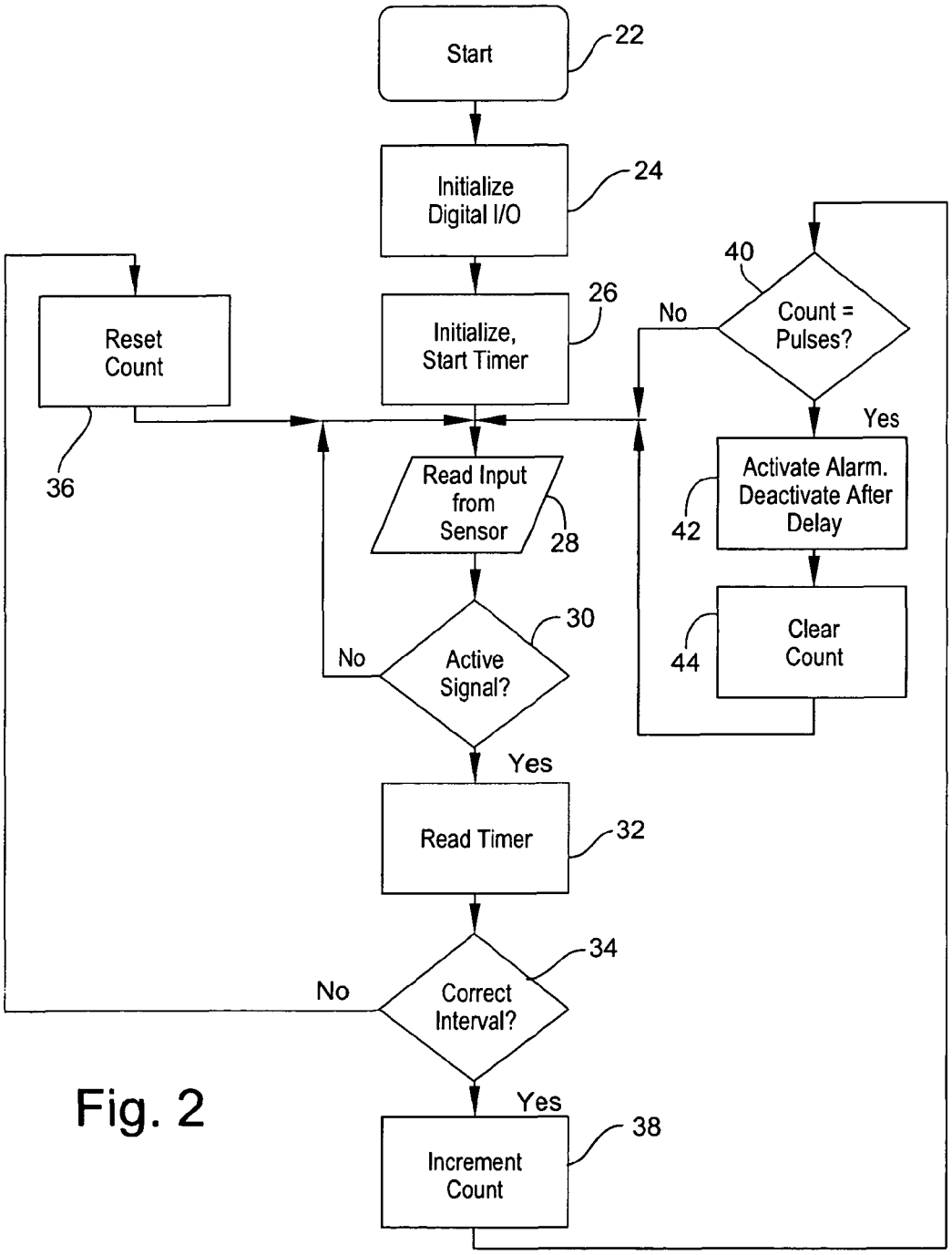
FIG. 2 shows a flow chart employing the algorithm of FIG. 1.

Microcontroller 16 runs software employing the method and algorithm 20 shown in FIGS. 2 and 3. Microcontroller 16 monitors the digital output or digital signal or digital pulse from the signal conditioner 14 and, when proper conditions are met, activates the alarm or warning device 18.

For example, as indicated above, an analog signal or analog pulse generated by the sensor 12 may carry with it information on the duration of the flash or the duration of one pulse of strobe light. However, two analog signals back to back, as generated by the sensor 12, conveys further information. This additional information is the time or interval between two analog signals. After being processed by the signal conditioner 14, this information, in the form of digitized signals, is monitored by the microcontroller 16. Thus the microcontroller 16 may monitor at least the following information: 1) the duration of the flash or the duration of one pulse of strobe light, and 2) the time interval between two consecutive (back to back) pulses of strobe light.

A right of way vehicle or emergency vehicle may have a strobe light with certain system specifications or certain features. For example, a particular strobe light may have a modulation frequency in a range from 14 hertz to 30 hertz (cycles or pulses per second). When an incoming signal at the correct or required frequency of, for instance, 14 hertz, is detected by the microcontroller 16, the microcontroller 16 commands operation of the alarm or warning device 18. A correct or required frequency may not be an exact frequency of 14 hertz. A correct or required frequency may be a frequency in a correct or required or predefined range of, for instance, 14 hertz to 30 hertz. The unit hertz (Hz) is a measure of frequency, defined as the number of cycles per second.

The microcontroller 16 measures, via the method of FIG. 2 or the algorithm of FIG. 3, the time between two consecutive (back to back) incoming signal pulses or digital pulses. This time, for example, may be measured between the start of a first incoming pulse (first in time digital pulse) and the start of the immediate subsequent pulse (second in time digital pulse). Alternatively, this time may be measured between the end of the first incoming pulse (first in time digital pulse) and the end of the immediate subsequent pulse (second in time digital pulse). Where the time between incoming signal pulses is measured from the start of a first pulse (first in time digital pulse) to the start of the next or second pulse (second in time digital pulse), an incoming modulated signal of 14 hertz may have a pulse train with a time of 71.4 milliseconds between the start of a first pulse (first in time digital pulse) to the start of the next or second pulse (second in time digital pulse).

The method of FIG. 2, or the algorithm of FIG. 3, or the software embodying such, loops and waits for a digital pulse from the signal conditioner 14. When one is detected, the method reads an onboard timer and records the time of the start of this pulse (first in time digital pulse or first detected pulse). Then the method loops back and waits for another pulse (a second in time digital pulse or second detected pulse). When this one is received, the method time stamps or records the time of the start of such immediate next pulse (the second in time digital pulse), and thus the method can now begin to compare and measure the time between pulses, such as the time between the beginning of one pulse (first in time digital pulse) and the beginning of the next pulse (first in time digital pulse). If the correct or required or predefined time value has been received (which time value is configurable), and if some specified sequential quantity have been received (which specified sequential quantity is configurable), the microcontroller 16 commands the activation of the alarm or warning device 18. It should be noted that the correct or required time value or time between pulses is preferably set or configured to be a particular time period or range of time or time interval, such as 71.4 milliseconds plus or minus a tolerance of 2 milliseconds or between about 69.4 milliseconds and about 73.4 milliseconds.

Finally, the method of FIG. 2 and the algorithm of FIG. 3 deactivates the alarm or warning device 18 after a specified period of time, whereupon the method is rearmed or again starts to loop and wait for further signal detection and operation such as for further infrared signal detection and operation.

It should be noted that an output of the signal conditioner 14, or an input to the microcontroller 16 includes a first in time digital pulse and a consecutive second in time digital pulse, that the microcontroller 16 includes a timer, and that the microcontroller 16 may include specifications for A) a required interval defined by a required time between said first in time digital pulse and said second in time digital pulse, B) a required number of consecutive digital pulses that have fallen into said required interval, whereupon the microcontroller commands activation of the alarm or warning device 18.

Alarm or Warning Device 18

Alarm or warning device 18 can be either or both of an audio alarm and visual alarm.

An example of an audio alarm is a speaker, wherein the microcontroller 16 can selectively generate one or more of a great variety of stored audio alarms. The audio alarm may selectively be a siren itself in the nature of the siren of an emergency vehicle or right of way vehicle and, it should be noted, emergency vehicles and right of way vehicle can emit a great variety of sirens. The audio alarm may selectively be a computer generated voice. The computer generated voice may selectively pronounce, for instance: "Warning. Emergency vehicle in area. Take caution."

Examples of visual alarms include the following: 1) a display or monitor, 2) a small display or monitor on a navigation apparatus, 3) a display or monitor built in to a dashboard on a vehicle, 4) a projection device projecting a warning onto the windshield of the vehicle that spells out a warning, 5) circuitry in the windshield of the vehicle itself that can be activated so as to spell out a warning, and/or 6) a display or monitor on a cell phone.

It should be noted that the connection between the microcontroller 16 and the alarm or warning device 18 may be hard wired or wireless.

A Power Unit

Control apparatus 10 further includes a power unit such as a battery or photovoltaic cell. Sensor 12 may or may not double as each of a power unit and sensor.

Housing for the Control Apparatus 10

The control apparatus 10 may be housed in a cell phone, a rear view mirror, a navigation system, a telematics system, a license plate, a center high mounted brake light, or in a small stand alone apparatus that may be as small as the size of a conventional credit card.

The components of the control apparatus 10 may be housed separately, such as in different portions of a vehicle. For example, the sensor 12 and signal conditioner 14 may be housed at a relatively high location on a vehicle, such as on a roof of a vehicle, on the upper tip of an antenna, on or near the upper portion of a rear windshield, on or near the upper portion of a front windshield, or at other exposed locations where chances are maximized that a strobe light can be picked up and will not be blocked by other portions of the vehicle. The signal conditioner 14 may send its digital signal wirelessly to another portion of the vehicle where the microcontroller 16 is housed. In turn, the microcontroller 16 may communicate wirelessly to still another portion of the vehicle where the alarm or warning device 18 is housed.

Moreover, the control apparatus 10 may include one or more sensors 12 located on different portions of the vehicle so as to even further maximize the chances that a strobe light of an emergency vehicle will be picked up. For example, one or more sensors 12 may be located on a side or sides of a vehicle such as to the post between a front door and a rear door. Each of such variously located sensors 12 may have a signal conditioner 14 and communicate wirelessly with a central microcontroller 16.

The Method and Algorithm

Reference number 22 in FIG. 2 indicates the step of starting the control apparatus 10. The step of starting the control apparatus 10 may be accomplished by connecting a power unit or source to the control apparatus 10, such as by connecting a photovoltaic cell to the control apparatus 10 and exposing the control apparatus 10 to a light source, or placing a battery unit into a housing having the control apparatus 10. The control apparatus 10 may be always on, drawing only milliwatts, microwatts or nanowatts from the power source. Or the step of starting the control apparatus 10 can include the step of turning on a switch that supplies power to the control apparatus 10 from a power source.

Reference number 22 in FIG. 2 also indicates the step of initializing the variables or initializing all variables. A variable is a symbol or name that stands for a value. "x" and "y" are examples of symbols that may stand for a value. In this case, the variables are 1) a first in time value variable, 2) a second in time value variable, 3) a required interval variable, 4) a count variable, and 5) a pulses variable. When the method of the control apparatus 10 is run, each of the variables is replaced with real data. A variable is not a constant. A constant is a value that does not change. Constants and variables are opposite concepts.

In the present method, one variable is a first in time value variable. This first in time value variable is a timer count from the first in time digital pulse. In other words, as shown in FIG. 3, this variable can also be referred to as the "last timer value" variable. The last timer value is the timer count from the last pulse, defined as the amount of time that has passed from the beginning of the immediately preceding pulse.

Another variable is the second in time value variable. This second in time value variable is a timer count from the second in time digital pulse. In other words, as shown in FIG. 3, this variable can also be referred to as the "current timer value" variable. The current timer value is the timer count from the current active pulse, defined as the point in time of the start of the current active pulse.

Another variable is the required interval variable. The required interval is the required time between the first in time digital pulse and the second in time digital pulse plus or minus a tolerance. In other words, as shown in FIG. 3, this variable can also be referred to as the "interval" variable. The interval is the required time between pulses, defined as the required time between the start of one pulse and the start of the immediate following pulse. The method provides a tolerance for this interval.

Another variable is the count variable. The count is the current number of consecutive digital pulses that have fallen into the required interval. As shown in FIG. 3, the count can also be referred to as the current number of consecutive correctly spaced pulses, where a pulse is defined as a digital pulse signal or digital pulse received from signal conditioner 14.

Another variable is the pulses variable. The pulses variable is the required number of consecutive digital pulses that have fallen into the required interval to activate the alarm or warning device 18. As shown in FIG. 3, this variable can also be referred to as the required number of consecutive correctly spaced pulses before alarm, defined as the required number of consecutive correctly spaced pulses in order to command the activation of the alarm or warning device 18.

Reference number 24 in FIG. 2 indicates the step of initializing inputs and outputs. Microcontroller 16 has an input/output processing section having a plurality of input/output processing units, one of which is associated with the signal conditioner 14 and one of which is associated with the alarm 18. This step detects and reports successful or failed communication with each of the signal conditioner 14 and alarm 18.

Reference number 26 in FIG. 2 indicates the step of initializing timers, defined as detecting and reporting successful or failed communication with one or more timers or clocks built into the microcontroller 16.

After successful initialization, the method proceeds to the step of reading inputs from sensor 12. This step is indicated in FIG. 2 by the reference number 28. More specifically, this step is the step of reading a digital input from the signal conditioner 14, which digital inputs or digital pulses are dictated by the analog inputs or analog pulses from the sensor 12.

The method then proceeds to the step 30, shown in FIG. 2. Step 30 is the step of inquiring whether the digital signal received from the signal conditioner 14 is active. In other words, step 30 inquires whether an infrared pulse is present. (Step 30 may also or instead inquire whether an ultraviolet pulse is present, or a pulse of visible light is present.) If the method receives a negative response as to whether an infrared pulse is present, the method loops back to step 28 (the step of reading inputs from the signal conditioner 14). If the method receives a positive response, the method proceeds to step 32.

Step 32, shown in FIG. 2, is the step of reading the timer. The method performs the step of reading the timer by, as shown in FIG. 3, moving the current timer value (second in time digital pulse) to the last timer value (first in time digital pulse), reading the timer value and storing such as the current timer value (second in time digital pulse), and subtracting the last timer value (first in time digital pulse) from the current timer value. The method then proceeds to step 34.

In step 34, shown in FIG. 2, the method analyzes the subtraction result of step 32 by determining whether the result falls into the correct or required range of the interval. If the result is not equal to (i.e., does not fall into) the required interval (required time between pulses plus or minus a tolerance), then the method proceeds to step 36, shown in FIG. 2, where the method resets the count to zero, whereupon the method proceeds to step 28 (the step of reading inputs from the signal conditioner 14). If the result is equal to (i.e., falls into) the required interval (required time between pulses plus or minus a tolerance), then the method proceeds to step 38.

Step 38 is the step of counting by increments or counting pulses one by one. The method then proceeds to step 40.

In step 40, shown in FIG. 2, the method analyzes the addition result of step 38. This step 38 is the step of counting the correct pulses or correct digital inputs or correct digital pulses from signal conditioner 14 over a period of time. If the number does not equal 14 over a period of one second or a predefined proportional value (14 hertz or 14 correct digital pulses per second), then the method proceeds to step 28 (the step of reading inputs from the signal conditioner 14). It should be noted that the increment count of step 38 may be cleared or reset by step 36. It should be noted that an increment count may be as a few as a count of two (two correct digital inputs from the signal conditioner 14 back to back). However, it is preferred that the step of counting by increments be performed over a period of time such as one or two seconds. If the number of correct pulses equals 14 over a period of one second (or a proportional value), then the method proceeds to step 42. The "required number of sequential pulses" can be set to any value such as from two to hundreds or more. The "period of time" can also be set to any value, such as from one-tenth of a second to a second to a minute or to an hour or to 24 hours or more.

Step 42, shown in FIG. 2, is the step of activating the alarm or warning device 18 and then turning off the alarm or warning device 18 after a delay. Then the method proceeds to step 44.

Step 44, shown in FIG. 2, is the step of clearing the count. The method then proceeds to step 28 (the step of reading inputs from the signal conditioner 14).

It should be noted that the method may include a further delay step. For example, after alarm or warning device 18 is activated, it may be inadvisable to have the control apparatus 10 start the alarm or warning device 18 almost immediately a second time. For example, a right of way vehicle or an emergency vehicle may throw out a strobe light over a distance of 100 meters, or 200 meters, or 400 meters, or a half-mile or a mile. Over time then, perhaps about five seconds, or ten seconds, or thirty seconds, or one minute, the right of way vehicle or emergency vehicle will pass the vehicle having the present control apparatus 10 and its strobe light will no longer throw light in the direction of the vehicle having the control apparatus 10. During such a time period, a driver of the vehicle having the control apparatus 10 may not wish to hear repeated warnings. On the other hand, it is inadvisable and not preferable to have a switch that would enable the driver of the vehicle to turn off the control apparatus 10. For example, even well intended drivers may forget to again turn on the control apparatus 10.

Incorporation by Reference

This application incorporates by reference in their entireties the following U.S. Patents, U.S. Patent Application Publications, and U.S. Patent Applications: 1) the McKenna U.S. Pat. No. 5,495,243 issued Feb. 27, 1996 and entitled Emergency Vehicle Alarm System For Vehicles; 2) the Henry et al. U.S. Pat. No. 6,094,148 issued Jul. 25, 2000 and entitled Vehicular Emergency Vehicle Alarm Apparatus; 3) the McKenna U.S. Pat. No. 6,252,519 issued Jun. 26, 2001 and entitled Emergency Vehicle Signaling System; 4) the McKenna U.S. Pat. No. 7,446,674 issued Nov. 4, 2008 and entitled Emergency Warning System For Approach Of Right Of Way Vehicle; 5) the McKenna U.S. Patent Application Publication Number 2006/0255966 A1 published Nov. 16, 2006 and entitled Emergency Warning System For Approach Of Right Of Way Vehicle; 6) the McKenna U.S. Patent Application Publication Number 2007/0046499 A1 published Mar. 1, 2007 and entitled Emergency Warning System For Approach Of Right Of Way Vehicle; 7) the McKenna U.S. patent application Ser. No. 12/008,061 filed Jan. 7, 2008 and entitled Navigation Apparatus Having Emergency Warning System.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A control apparatus comprising:

a) a light sensor;

b) a warning device;

c) a microcontroller connected between the light sensor and the warning device and comprising an algorithm for analyzing outputs of the light sensor, wherein the algorithm controls operation of the warning device;

d) a signal conditioner connected between the sensor and the microcontroller, wherein an output of the signal conditioner includes a first in time digital pulse and a consecutive second in time digital pulse;

e) wherein the microcontroller includes a timer, wherein the microcontroller includes specifications for A) a required interval defined by a required time between said first in time digital pulse and said second in time digital pulse, B) a required number of consecutive digital pulses that have fallen into said required interval; and f) wherein the microcontroller includes an algorithm having variables that comprise:

i) a first in time value variable, wherein the first in time value is a timer count from said first in time digital pulse;

ii) a second in time value variable, wherein the second in time value is a timer count from said second in time digital pulse;

iii) a required interval variable, wherein the required interval is said required time between the first in time digital pulse and the second in time digital pulse plus or minus a tolerance;

iv) a count variable, wherein the count is a current number of consecutive digital pulses that have fallen into said required interval; and v) a pulses variable, wherein the pulses is a required number of consecutive digital pulses that have fallen into said required interval to activate said warning device.

2. The control apparatus of claim 1, wherein the light sensor is an infrared light sensor.

3. The control apparatus of claim 1, wherein the warning device is one of an audio warning device and visual warning device.

4. The control apparatus of claim 1, wherein said warning device provides each of an audio warning and a visual warning.

5. The control apparatus of claim 1, wherein the control apparatus is a right of way vehicle warning apparatus.

6. A method for turning on a warning device in response to a strobe emitting pulses of light, comprising the steps of:

a) sensing a pulse of light from said strobe and converting said pulse of light into an analog pulse;

b) converting said analog pulse into a digital pulse;

c) recording a first time for a first digital pulse;

d) recording a second time for a second digital pulse that occurs consecutively after said first digital pulse;

e) analyzing whether a time period between the first and second times have fallen into a required time interval, wherein said required time interval is a required time between the first and second digital pulses plus or minus a tolerance;

f) counting a number of consecutive digital pulses that have fallen into said required time interval; and g) turning on said warning device when said number of consecutive digital pulses have attained a warning device requirement defined by a required number of consecutive digital pulses over a required period of time.

7. The method of claim 6, and further comprising the steps of a) ceasing the step of analyzing when a time period between said first and second times have fallen out of said required time interval and then b) looping back to the step of recording a first time for a first digital pulse.

8. The method of claim 6, and further comprising the steps of a) stopping the step of counting when a number of consecutive digital pulses have failed to attain said warning device requirement and then b) looping back to the step of recording a first time for a first digital pulse.

9. The method of claim 6, and further comprising the step of configuring said required time interval to be one of a) about 71.4 milliseconds and b) 71.4 milliseconds plus or minus a tolerance.

10. The method of claim 6, and further comprising the step of configuring said warning device requirement to be one of a) 14 consecutive digital pulses over a required time period of one second and b) a number proportional to 14 consecutive digital pulses over a required time period of one second.

11. The method of claim 6, wherein said step of sensing a pulse of light from said strobe comprises the step of sensing a pulse of infrared light from said strobe.

12. A control apparatus for turning on a warning device in response to a strobe emitting pulses of light, comprising:

a) a light sensor;

b) a warning device;

c) a microcontroller connected between the light sensor and the warning device and comprising an algorithm for analyzing outputs of the light sensor, wherein the algorithm controls operation of the warning device;

d) a signal conditioner connected between the light sensor and the microcontroller, wherein an output of the signal conditioner includes a first in time digital pulse and a consecutive second in time digital pulse; and e) wherein the microcontroller includes a timer, wherein the microcontroller includes specifications for A) a required interval defined by a required time between said first in time digital pulse and said second in time digital pulse, B) a required number of consecutive digital pulses that have fallen into said required interval.

13. The control apparatus of claim 12, wherein said required time interval is configurable by an end user.

14. The control apparatus of claim 12, wherein said required time interval is reconfigurable.

15. The control apparatus of claim 12, wherein said required number of consecutive digital pulses is configurable by an end user.

16. The control apparatus of claim 12, wherein said required number of consecutive digital pulses is reconfigurable.

* * * * *